US007370861B2

(12) United States Patent
Aoyagi et al.

(10) Patent No.: US 7,370,861 B2
(45) Date of Patent: May 13, 2008

(54) SHEET HOLDING APPARATUS AND SHEET TRANSPORT APPARATUS EQUIPPED WITH THE SAME

(75) Inventors: Tatsuzo Aoyagi, Minami-Alps (JP); Tatsuya Niwa, Yamanashi-ken (JP); Yoshihiko Minagawa, Minami-Alps (JP)

(73) Assignee: Nisca Corporation, Minamikoma-Gun, Yamanashi-ken (JP)

( * ) Notice: Subject to any disclaimer, the term of this patent is extended or adjusted under 35 U.S.C. 154(b) by 239 days.

(21) Appl. No.: 11/063,851

(22) Filed: Feb. 24, 2005

(65) Prior Publication Data

US 2005/0184448 A1 Aug. 25, 2005

(30) Foreign Application Priority Data

Feb. 25, 2004 (JP) ..... 2004-049393

(51) Int. Cl.
*B65H 43/00* (2006.01)

(52) U.S. Cl. ..... 271/176; 271/207; 271/220

(58) Field of Classification Search ..... 271/207, 271/220, 176; 355/408; 399/377, 371, 376, 399/370

See application file for complete search history.

(56) References Cited

U.S. PATENT DOCUMENTS 5,033,731 A * 7/1991 Looney ..... 271/176
6,113,094 A * 9/2000 Horiguchi et al. ..... 271/176
6,190,116 B1 * 2/2001 Asada ..... 414/790.7

FOREIGN PATENT DOCUMENTS

| | | |
|---|---|---|
| JP | 06-247617 | 9/1994 |
| JP | 07-172684 | 7/1995 |
| JP | 11-116134 | 4/1999 |

* cited by examiner

*Primary Examiner*—Kaitlin S Joerger
(74) *Attorney, Agent, or Firm*—Manabu Kanesaka

(57) ABSTRACT

A detection sensor detects a position of a level detection lever that touches an uppermost sheet of sheets stacked on a holding tray, and a computing device counts the number of sheets that have been discharged to the holding tray. A judging device judges the amount of sheets stacked based on a sheet surface level detection signal from the detection sensor and a count value of the computing device. The apparatus accurately judges that the maximum amount of sheets have been stacked in the holding tray according to the position of the level detection lever and a count value for a number of sheets. Also, the apparatus selects one of a plurality of values for an offset sheet count, which corresponds to the operating conditions, namely the transporting speed of sheets, the intervals between sheets, and the length of the transport direction of the sheets.

11 Claims, 12 Drawing Sheets

(Average Value of Detected Sheets) Detection Height: 9.5 mm

| Speed: 388 mm/s | | | | | | |
|---|---|---|---|---|---|---|
| Paper Size | LG Vertical/B4 Vertical | | LT Vertical/A4 Vertical | | B5 Vertical | |
| Single/Duplex | Single-side | Duplex | Single-side | Duplex | Single-side | Duplex |
| Detected Sheets | 18.7 | 17.3 | 34.3 | 38.3 | 58.3 | 57 |
| Corrected Sheets | 51 | 53 | 36 | 32 | 12 | 13 |
| Total | 69.7 | 70.3 | 70.3 | 70.3 | 70.3 | 70 |

| Speed: 197 mm/s | | | | | | |
|---|---|---|---|---|---|---|
| Paper Size | LG Vertical/B4 Vertical | | LT Vertical/A4 Vertical | | B5 Vertical | |
| Single/Duplex | Single-side | Duplex | Single-side | Duplex | Single-side | Duplex |
| Detected Sheets | 20 | 22.7 | 37.7 | 36.7 | 64 | 65.6 |
| Corrected Sheets | 50 | 47 | 32 | 33 | 6 | 4 |
| Total | 70 | 69.7 | 69.7 | 69.7 | 70 | 69.6 |

| Speed: 97 mm/s | | | | | | |
|---|---|---|---|---|---|---|
| Paper Size | LG Vertical/B4 Vertical | | LT Vertical/A4 Vertical | | B5 Vertical | |
| Single/Duplex | Single-side | Duplex | Single-side | Duplex | Single-side | Duplex |
| Detected Sheets | 24 | 22.3 | 39 | 44.3 | 70.2 | 64.3 |
| Corrected Sheets | 56 | 48 | 31 | 26 | 0 | 6 |
| Total | 80 | 70.3 | 70 | 70.3 | 70.2 | 70.3 |

FIG. 12

SHEET HOLDING APPARATUS AND SHEET TRANSPORT APPARATUS EQUIPPED WITH THE SAME

BACKGROUND OF THE INVENTION AND RELATED ART STATEMENT

The present invention relates to a sheet holding apparatus that sequentially stacks sheets transported from a printer or a copier or other image forming apparatus for holding, or that sequentially stacks sheets such as original sheets that are supplied to a scanner, facsimile or other image reading apparatus, and more particularly to a sheet transport apparatus that employs a sheet stacking amount detection method for detecting the maximum amount of sheets that can be stacked on a tray, and a sheet holding apparatus.

Generally, a sheet holding apparatus that holds sheets which have been formed with images by an image forming apparatus, such as a printer, in a holding tray, or sheets which have been read by an image reading apparatus, such as a scanner, and that sequentially transports sheets from a transport path into a holding tray for stacking and holding is widely known in the art.

Subsequently fed sheets can become jammed inside the apparatus on such a sheet holding apparatus when a number of sheets that exceeds a predetermined amount is held in its tray. Furthermore, sheets that have already been stacked on that tray can be pushed out causing them to become scattered. Therefore, it is necessary to apply some measure to stop the apparatus on the upstream side by judging, such as by using detection means, whether the sheets that have been stacked on the tray have reached a maximum limit of the tray.

Conventionally, as a means for detecting the maximum stacking amount of a tray, sheets that are sequentially transported are counted at the upstream side of the tray. When this counted value has reached a predetermined number of sheets, it is determined that the maximum amount that can be stacked on a tray has been reached and the apparatus is stopped. An example of this method is disclosed in the Japanese Patent Publication (KOKAI) 6-247617. Another type of detection means is disclosed in the Japanese Patent Publication (KOKAI) No. 7-172684. Here, a tray is provided with a detection lever which touches the uppermost sheet of those sheets stacked on the tray. A photoelectric sensor is used to detect the position of this detection lever so that when a predetermined level of the sheet surface is reached, the system judges that the maximum amount of sheets has been reached.

In the method described above for counting sheets, a sensor, such as a photodiode, is disposed to detect the presence of a sheet in the sheet transport path. In one well-known approach to this method, a counter counts the number sheets that pass this sensor; and in another well-known approach, as described in the Japanese patent mentioned above, a counter counts the number of sheet feeding command signals to ascertain the number of sheets that have been fed.

In the latter method, which uses a detection lever and sensor to detect the level of the stacked sheets, a lever member that is swingably supported is arranged to hang downward toward the top of the tray from thereabove. The leading edge of the lever detects the height level of the sheets by touching the uppermost sheet on the stack. A photosensor, such as a photodiode, is arranged on the base of the lever. When the detection lever has detected a predetermined height level, a photosensor detects that position thereby determining that the sheets have reached a maximum holding level. Such system is widely known.

On the other hand, in a sheet holding apparatus incorporated with a sheet transport apparatus such as a copier, or scanner for which compactness is a requirement, a tray has a capacity to hold several tens of sheets. Such an apparatus must hold a variety of paper thicknesses from very thin to thick sheets. However, depending on the transport conditions of the sheets, large anomalies can occur in the detection of the maximum volume of sheets that can be stacked. This can cause the apparatus to be stopped without being completely filled to the maximum amount that the tray can actually hold. This causes an operator to feel less secure with the apparatus and it can also cause paper jams or sheets to be disturbed in the tray.

Therefore, in an apparatus particularly configured with a compact holding tray to enable a more compact apparatus overall, it is necessary to detect the maximum amount of sheets in the tray as accurately as is possible. At the same time, normally such apparatuses have a plurality of operating modes whose transport speeds differ according to the processing conditions. For example, reading speeds can differ for reading color images and for reading black and white images. Thus, it is preferable to be able to vary the maximum number of sheets that can be stacked in accordance with the differences in these operating modes.

However, the maximum amount of sheets that can be stacked can vary, depending on the thickness of the sheets in use. Therefore, normally, the maximum amount of sheets that can be stacked is set to a standard. This is particularly true for sheets that are the maximum thickness, and that are held when they have the largest curl if the method described above for counting sheets is used. Therefore, regardless of whether using thick or thin sheets, and sheets being held with the least amount of curl, and whether there is still room left in the tray to accommodate more sheets, the apparatus still must be stopped if an error occurs. Furthermore, if previous sheets remain on the stacking tray, there is the potential for an overflow because there are no means for detecting such sheets. This can cause serious trouble on the machine such as damaging the original sheets by becoming jammed inside the machine.

On the other hand, with the method of detection that uses a detection lever to detect the level of the sheets, the leading edge of a sheet pushes this detection lever upward each time a sheet is transported and is stacked on the stacking tray. Therefore, the detection sensor must be able to detect the position of the detection lever at a position with even the slightest interval between sheets to judge that the number of sheets has reached a predetermined maximum level. Therefore, this system can experience detection errors when transporting sheets at high speeds or with short intervals therebetween.

Of particular note, when the volume of sheets on the stacking tray is low, the amount of movement of the detection lever is greater, so the sensor that detects this can judge sheet levels comparatively more accurately. However, as the number of sheets approaches the tolerance level of the tray, the amount of detection lever movement decreases thereby inviting erroneous detection of the level of sheets.

Furthermore, the number of misdetections of the position of a detection lever increases as the sheet transport speed increases, or as the intervals between sheets become shorter. This is because the leading edge of the next sheet pushes the detection lever upward and out of the way before the detection lever has had a chance to exit a sensor. This position (with the detection lever seemingly in a continuously raised position) is mistakenly judged as the surface level of the sheets.

In view of the problems associated with accurately judging the maximum amount of sheets that can be stacked (sequentially) in a stacking tray, an object of the present invention is to provide a sheet stacking amount detection method and sheet holding apparatus that can accurately judge the maximum amount of sheets that can be stacked on a stacking tray despite sheets already existing on the stacking tray, or if sheets are excessively curled, and that can accurately judge the maximum amount of sheets that can be stacked on a stacking tray even when conditions for transport are different, such as different transport speeds for the sheets, or the different intervals between sheets (caused by differences in operating modes).

Further objects and advantages of the invention will be apparent from the following description of the invention.

SUMMARY OF THE INVENTION

To solve the aforementioned problems, the present invention equips a detection sensor for detecting the position of a level detection lever that touches the uppermost sheet of sheets stacked on a holding tray; computing means for counting the number of sheets that have been discharged to the holding tray; and judging means for judging the amount of sheets stacked based on a sheet surface level detection signal from the detection sensor and a count value of the computing means.

For the judgment of the maximum amount of sheets that can be stacked, a sheet detection lever and detection sensor are employed to detect that sheets have been stacked at a predetermined height on a holding tray. Signals from this detection sensor activate computing means which count the number of sheets that are transported-out thereafter.

Then, the judging means recognizes the maximum tolerable amount of sheets when a predetermined number of sheets (which has been preset for a number of sheets to be counted by this computing means) is reached, and executes necessary processes. Also, the invention sets one from a plurality of setting values that correspond to the conditions under which it operates for a preset number of sheets to be counted, namely the transporting speed of sheets, the intervals between sheets, and the length of the transport direction of the sheets. Normally, an apparatus that forms images on sheets, or that reads the images on sheets, then transports them out to a holding tray, such as a sheet feeding apparatus, has a plurality of operating modes. These modes differ according to the transport speed of the sheets, the intervals therebetween sheets and the size of the sheets. The invention sets the optimum number of sheets from a plurality of setting values, and compares this with the number sheets that are counted by the computing means.

BRIEF DESCRIPTION OF THE DRAWINGS

FIG. 12 is actual data showing the status of detection of the surface of sheets using a level detection lever.

DETAILED DESCRIPTION OF PREFERRED EMBODIMENTS

Figure 1:
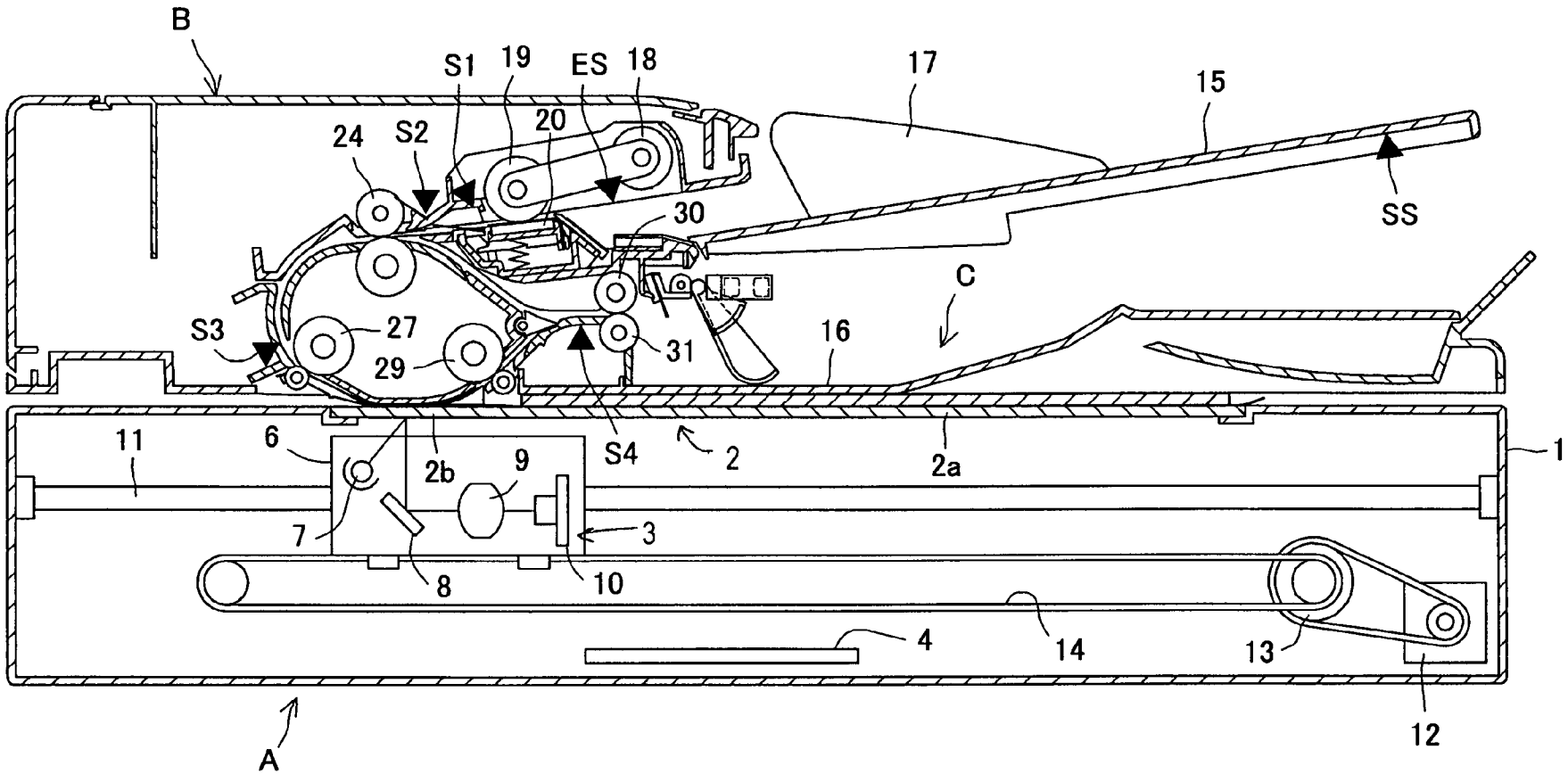
FIG. 1 is an overall view of an image reading apparatus including a sheet transport apparatus that is equipped with a sheet holding apparatus.
Figure 2:
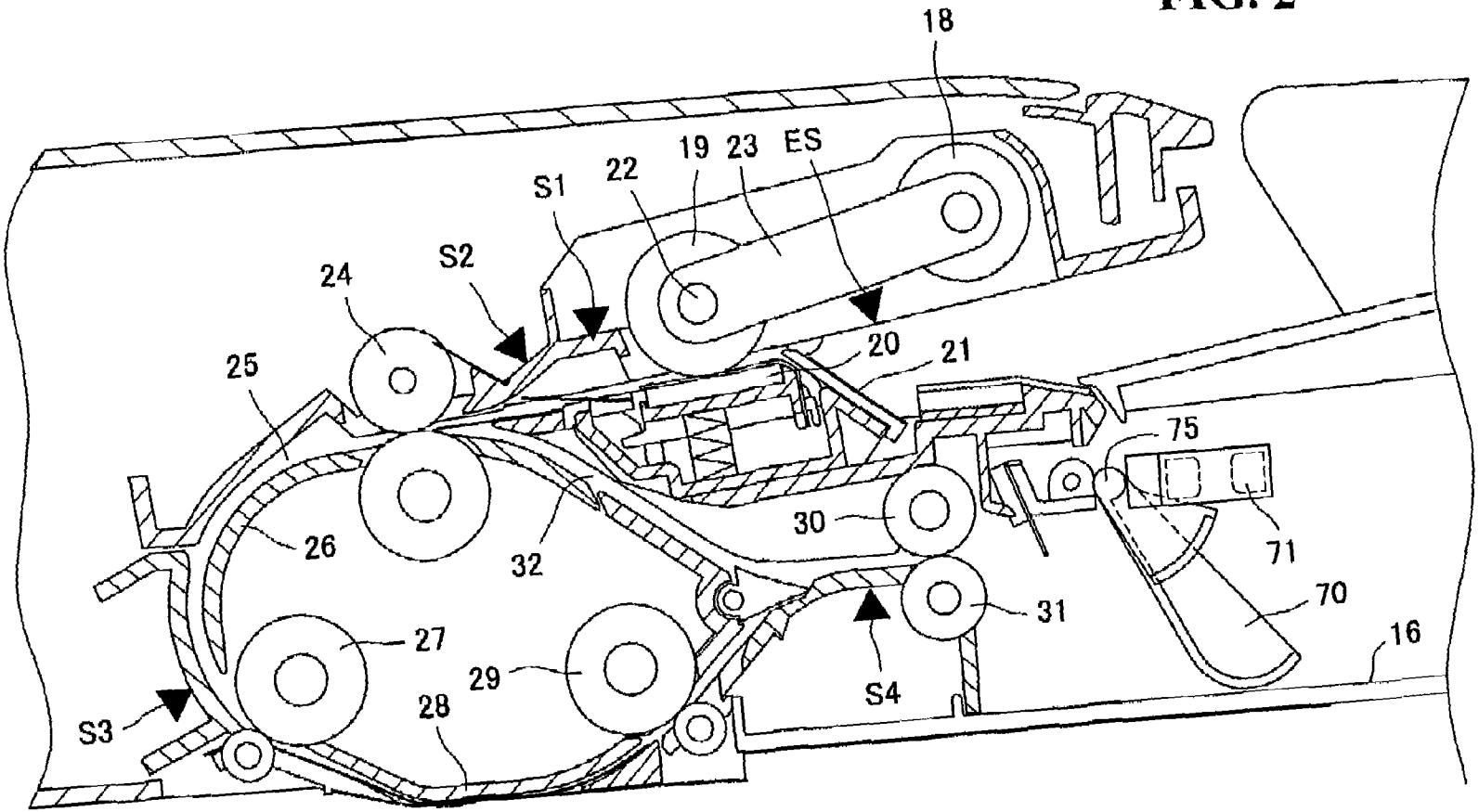
FIG. 2 is a view of a portion of the sheet transport apparatus.
Figure 3:
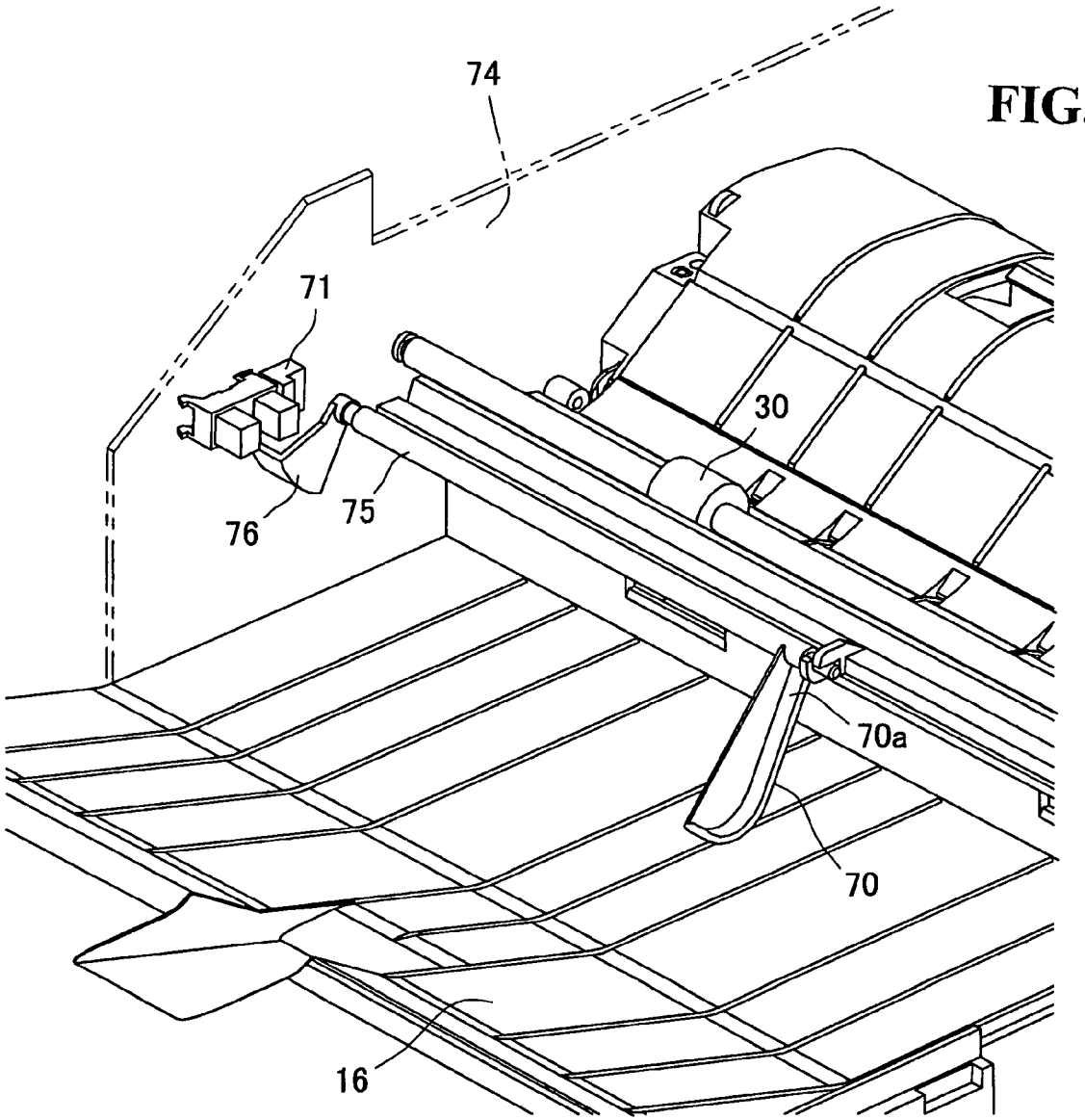
FIG. 3 is a perspective view of the portion of the sheet holding apparatus of FIG. 2.

Hereunder, preferred embodiments of the invention will be explained with reference to the accompanied drawings. FIG. 1 shows the sheet transport apparatus that incorporates the sheet holding apparatus, and the overall image reading apparatus that is equipped with these as a unit. FIG. 2 shows a portion of the sheet holding apparatus. FIG. 3 is a perspective view of the sheet surface level detection lever that is disposed on a sheet holding tray.

The letter 'A' in the drawing represents an image reading apparatus such as a scanner. Inside the casing 1 are embedded a platen 2 for placing sheet originals; a photoelectric reading mechanism unit 3 for reading by photoelectric conversion elements 10 of the sheet original placed on the platen 2; an image processing unit 4 for correcting image data received from this photoelectric conversion element 10; and a data transfer unit for transferring data received from the image processing unit 4 to an external unit.

A sheet transport apparatus B for automatically supplying sheet originals to the platen 2 is mounted as a unit to the image reading apparatus A. Sheet originals on a sheet feeding tray 15 are sequentially fed to a holding tray 16 via the platen 2. A sheet holding apparatus C is incorporated as a holding tray in the sheet transport apparatus B.

A first platen 2*a* for setting sheet originals and a second platen 2*b* for reading sheet originals that are fed by the sheet transport apparatus B are established in the casing 1 on the image reading apparatus A. Sheet originals that are readied at the first platen 2*a* or the second platen 2*b* are electrically read by the photoelectric reading mechanism unit. The photoelectric reading mechanism unit 3 is composed of a carriage 6 that travels at a predetermined speed along the platen 2; and a light source 7, mirror 8, condenser lens 9 and photoelectric conversion elements 10 mounted on the carriage 6. The carriage 6 is supported to reciprocatingly move to the left and right directions in FIG. 1 on a guide rail 11 that is mounted to the apparatus frame. It is interlocked to a drive wire 14 that is trained between a pair of pulleys 13 on the left and right sides. A carriage drive motor 12 is interlocked to the pulley 13. Thus, the carriage 6 is able to reciprocatingly move to the left and right directions of FIG. 1 at a predetermined speed.

Image data that is read by the photoelectric reading mechanism unit is sent to the image processing unit 4 where it is converted by the photoelectric conversion unit from analog signal data to binary (or multi-value data). There, it is also subjected to line correction, shading, gamma and dither correction, and then is output as electrical signals to a processing apparatus such as an external copier or printer. Details relating to those operations are discussed in further detail below.

The following explains the structure of the sheet transport apparatus B that is mounted over the second platen 2*b*. A sheet feeding tray 15 and holding tray 16 are arranged vertically above the platen 2. Sheet originals are fed sequentially from the sheet feeding tray 15 through a substantially U-shaped transport path 25 to the holding tray 16. The second platen 2*b* is arranged along that transport path 25. The sheet feeding tray 15 is formed by a flat tray that stacks sheet originals and is provided with side guides 17 that align the side edges of the sheet originals. Also, the apparatus includes an empty sensor ES for detecting whether there are sheet originals, and a size detection sensor SS for detecting the length of sheet originals disposed on the sheet feeding tray 15. A pick-up roller 18 that rises and lowers in the up and down directions and a separation roller 19 are disposed on the leading end of the sheet feeding tray 15. A friction pad member 20 presses against the separation roller 19. The symbol 21 in the drawing is a forward separating member for separating the leading edges of the sheet originals stacked on the tray.

The separating roller 19 is interlocked to a drive motor M1 (FIG. 5) that is described in further detailed below, and is mounted to a rotating shaft 22 that rotates in the clockwise direction of FIG. 1. Pick-up roller 18 is mounted to the bracket 23 which is swingably mounted to rotating shaft 22. A magnetic latch, not shown, is disposed between the rotating shaft 22 and bracket 23. The separating roller 19 rotates in a clockwise direction with the clockwise rotation of the rotating shaft and the magnetic latch becomes detached so the bracket 23 lowers under its own weight from the idled position where it is retracted in the upper direction of the FIG. 1, to an operating position where it is in contact with the uppermost sheet on the sheet feeding tray 15. A transmission belt, which is described in further detail below, transmits the rotation of the rotating shaft 22 to the pick-up roller 18 to rotate it in the clockwise direction of FIG. 1. Therefore, sheets that are stacked on the sheet feeding tray 15 and kicked out by the pick-up roller 18, are separated by the separating member 21 so that only the uppermost sheet is separated and kicked out by the separating roller 19 and friction pad member 20.

The leading edge of the sheet kicked out by the separating roller 19 is aligned by the registration means which are composed of a pair of registration rollers 24 on the upstream side. In the normal configuration, the pair of registration rollers 24 is configured of a pair of rollers that are in mutual contact. While the pair of registration rollers is stopped, the leading edge of a sheet enters into the nipping point therebetween these rollers. When a curl is thus formed in the sheet, any skewing in the sheet (misalignment of the direction of the sheet) is corrected at the separation roller position 19.

A U-shaped transport path 25 is formed by a transport guide 26 between the sheet feeding tray 15 and the holding tray 16. The pair of registration rollers 24 is disposed in this transport path 25. A transport-in roller 27, backup plate 28, transport-out roller 29 and a pair of discharge rollers 30 and 31 is each arranged downstream of the pair of registration rollers 24.

The transport-in roller 27, transport-out roller 29, and the pair of discharge rollers 30 and 31 are interlocked to a drive motor M2 (FIG. 6) that is described in further detail below. These mechanisms define transport means for transporting a sheet original at the same speed from the pair of registration rollers 24 to the holding tray 16.

Of the rollers mentioned above, the pair of discharge rollers 30 and 31 rotates in the forward and reverse directions in synchronization with the drive motor M2 which is capable of both forward and reverse drives. The transport-in roller 27 and the transport-out roller 29 constantly rotate in one direction, in the counterclockwise direction of FIG. 1, despite the forward and reverse rotation of the motor M2, via a one-way clutch that is established between these rollers and the drive motor M2.

A recirculating path 32 is connected to the transport path 25 to guide sheet originals from the pair of discharge rollers 30 and 31 to the pair of registration rollers 24. When in the single side reading mode, the sheet original which has reached the pair of discharge rollers 30 and 31 is sent to the holding tray as is. However, in the duplex reading mode, after the leading edge of the sheet original has reached the pair of discharge rollers 30 and 31, the drive motor M2 rotates in the reverse direction to send the sheet original to the recirculating path 32. The sheet is thus resent from the pair of registration rollers 24 to the platen 2*b*. Therefore, a sheet original, one side of which has been read at the platen 2*b*, is sent again to the platen 2*b* through the recirculating path 32. This enables the backside of the sheet originals to be read. After the reading process, the sheet original is transported out to the holding tray 16.

Figure 5:
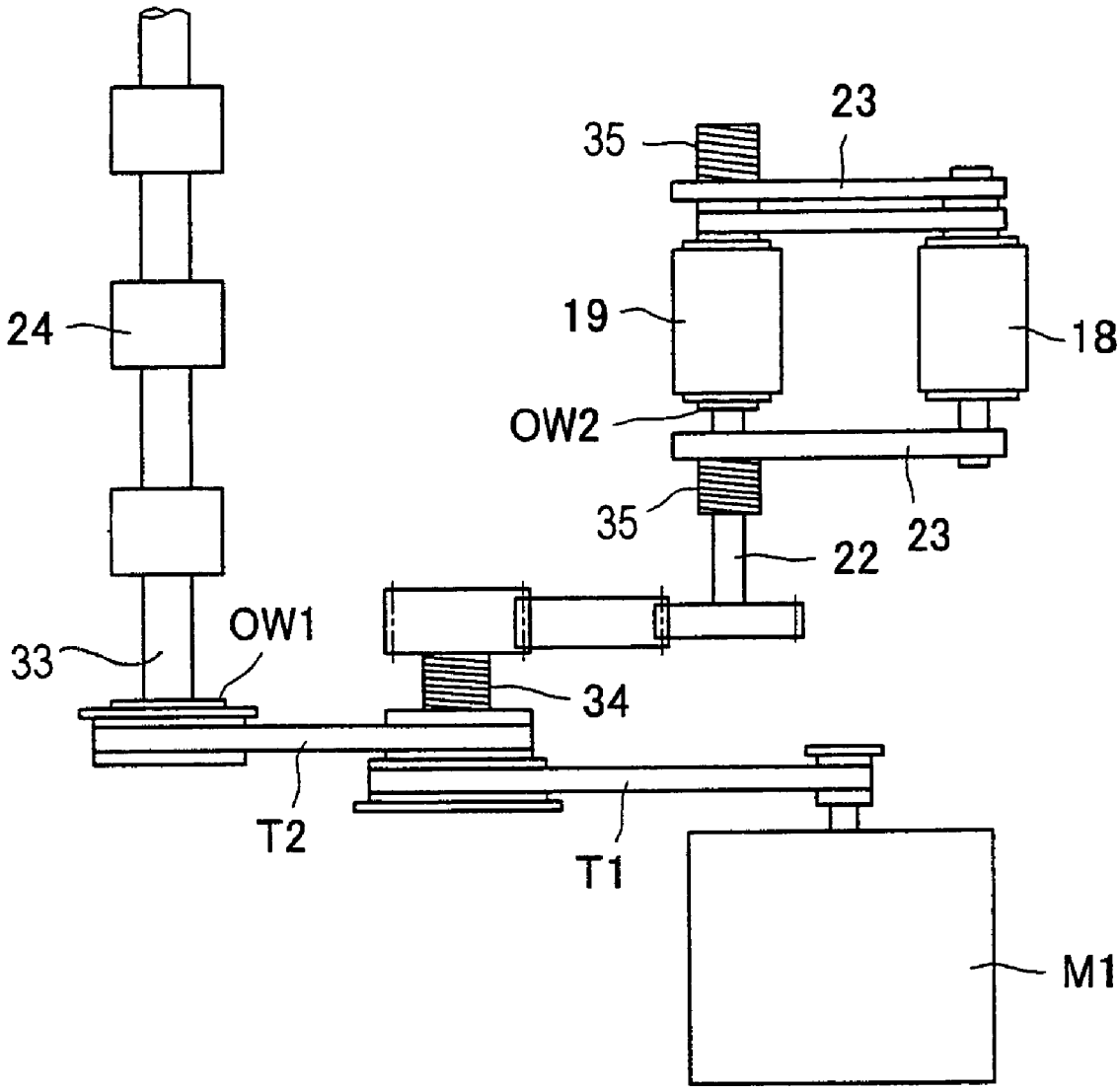
FIG. 5 is a view of the separation rollers and registration rollers drive mechanism in the sheet transport apparatus.
Figure 6:
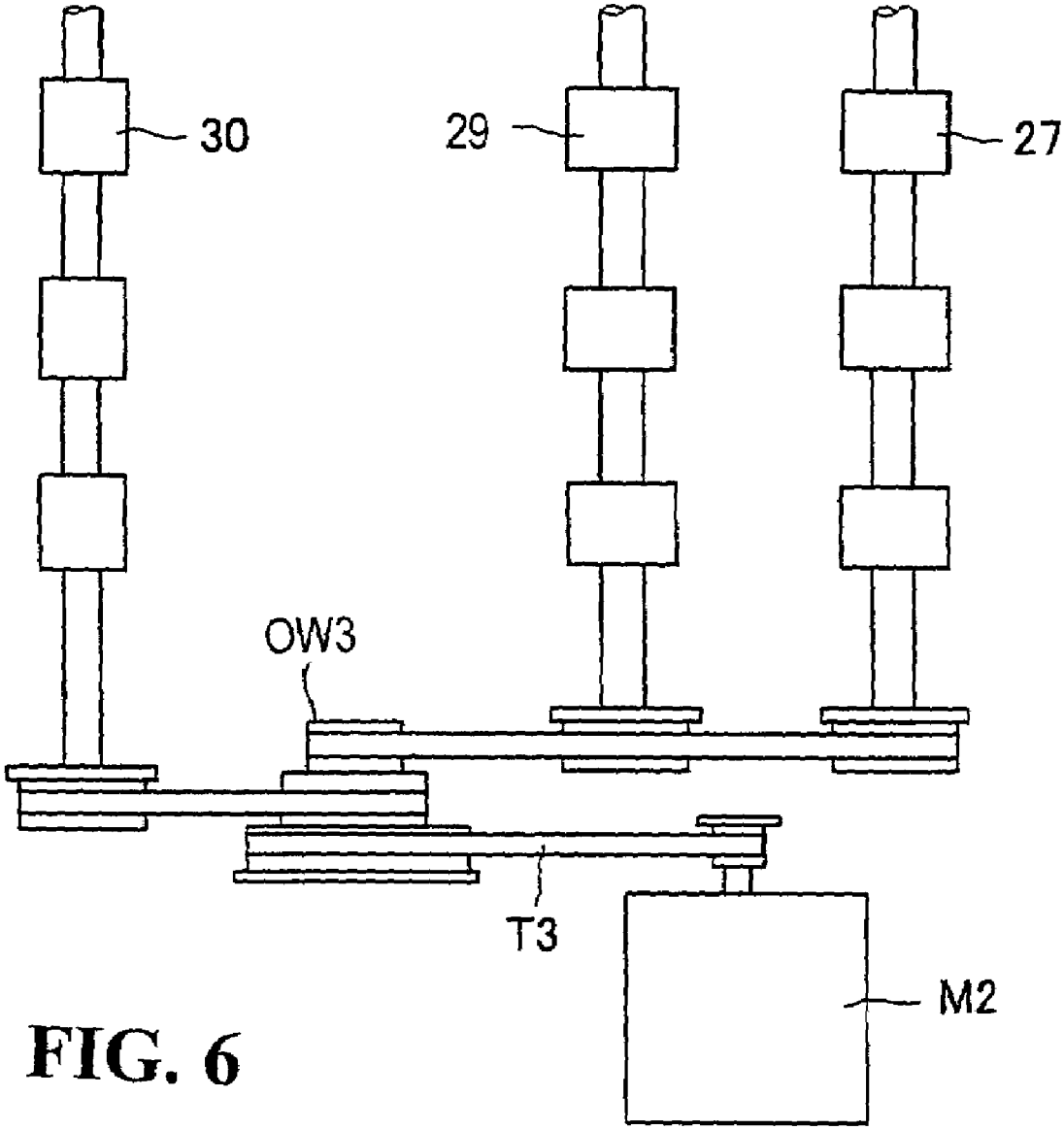
FIG. 6 is a view of the transport rollers, transport-out rollers and discharge rollers drive mechanism in the sheet transport apparatus.

Next, the drive mechanism for transporting a sheet original from the sheet feeding tray 15 to the holding tray 16 shall be described in reference to FIG. 5 and FIG. 6. The pick-up roller 18, separating roller 19, pair of registration rollers 24, transport-in roller 27, transport-out roller 29, and the pair of discharge rollers 30 and 31 are arranged in the transport path 25. However, these are interlocked to the drive motors M1 and M2 which are capable of both forward and reverse drives. As can be seen in FIG. 5, the first drive motor M1 drives the separating roller 19, the pick-up roller 18 and the pair of registration rollers 24 that are interlocked thereto. When rotating in the forward direction, drive motor M1 drives the separating roller 19 and the pick-up roller 18, and when drive motor M1 rotates in the reverse direction, it drives the pair of registration rollers 24. Simultaneously, the forward and reverse rotation of the drive motor M1 controls the raising and lowering of the pickup roller 18 in the up and down directions.

The drive motor M1 is interlocked to the pair of registration rollers 24 via transmission belts T1 and T2. A one-way clutch OW1 is embedded in the rotating shaft 33 of the pair of registration rollers 24 to transmit only one direction of rotation to these rollers. At the same time, this drive motor M1 transmits the drive to the rotating shaft 22 of the separating roller 19 via a spring clutch 34. A bracket 23 is supported on the rotating shaft 22 via the spring clutch 34. Drive is transmitted to the pick-up roller 18 which is mounted on the bracket 23, by the transmission belt T1. Therefore, when the drive motor M1 rotates in the forward direction (in the clockwise direction of FIGS. 1 and 2) the spring clutch 34 contracts, transmitting rotating forces to the rotating shaft 22 of the separating roller 19, thereby causing the separating roller 19 and the pick-up roller 18 to rotate. Simultaneously to this, the spring clutch 35 of the rotating shaft 22 loosens, allowing the bracket 23 to come free. This, in turn, causes the pickup roller 18 to shift from an idling state shown in FIG. 1 to lower to the top of the sheet feeding tray 15 and come into contact with the uppermost sheet that is stacked thereupon. At this time, the one-way clutch OW1 is set so that it does not transmit the forward rotation of the motor M1 to the pair of registration rollers 24.

Therefore, the pick up roller 18 first lowers from an idling position above the tray with the forward rotation of the drive motor M1, and touches the uppermost sheet of the sheets that are stacked on the tray, to kick that sheet out. Next, the uppermost sheet is separated by the separating roller 19 and is transported to the pair of registration rollers 24 that are standing still. When the drive motor M1 rotates in the reverse direction, the spring clutch 34 which is held in a contracted state rotates the rotating shaft 22 in the counter-clockwise direction of FIGS. 1 and 2 to return the bracket 23 to an idling position that is above the tray. The rotation of the rotating shaft 22 at this time is transmitted by a one-way clutch OW2 which is embedded in the separating roller 19. There is a stopper, not shown, at the retracted position of the bracket 23. It checks any further rotation of the bracket 23 and the rotating shaft 22. When this occurs, the spring clutch 34 loosens and the rotation of the motor M1 is transmitted to the rotating shaft 22. Reverse rotation of the drive motor M1 is transmitted to the pair of registration rollers 24 to kick out the sheet.

As shown in FIG. 6, the drive motor M2 is interlocked via the transmission belt T3 to the transport-in roller 27, transport-out roller 29, and the pair of discharge rollers 30 and 31. A one-way clutch OW3 is configured to transmit the single-directional rotation of the motor, which drives in both forward and reverse, to the transport-in roller 27 and to the transport-out roller 29.

Referring back to FIGS. 1-2, there are sensors for detecting the leading edge and trailing edge of a sheet also disposed in the transport path 25. A separating sensor S1 is disposed directly behind the separating roller 19. If this does not detect a sheet after the passage of a predetermined amount of time after the rotating start signal (the paper feed instruction signal) of the separating roller 19, it stops the apparatus because of a paper jam. A registration sensor S2 is arranged just prior to the pair of registration rollers 24. This detects the arrival of the leading edge of a sheet, and issues a motor stop instruction signal to the control unit of the drive motor M1 after an amount of time to allow the predetermined registration loop to be formed in the sheet. A read sensor S3 is arranged just in front of the transport-in roller 27. This notifies the image reading apparatus A of the arrival of the leading edge of the sheet to set the image reading starting position on the platen 2*b*. A discharge sensor S4 is arranged on the upstream side of the pair of discharge rollers 30 and 31. This detects the leading edge and the trailing edge of a sheet to detect paper jams. At the same time, the discharge sensor S4 counts the number of sheets that have been transported out to the holding tray 16. This is described in further detail below.

Figure 7:
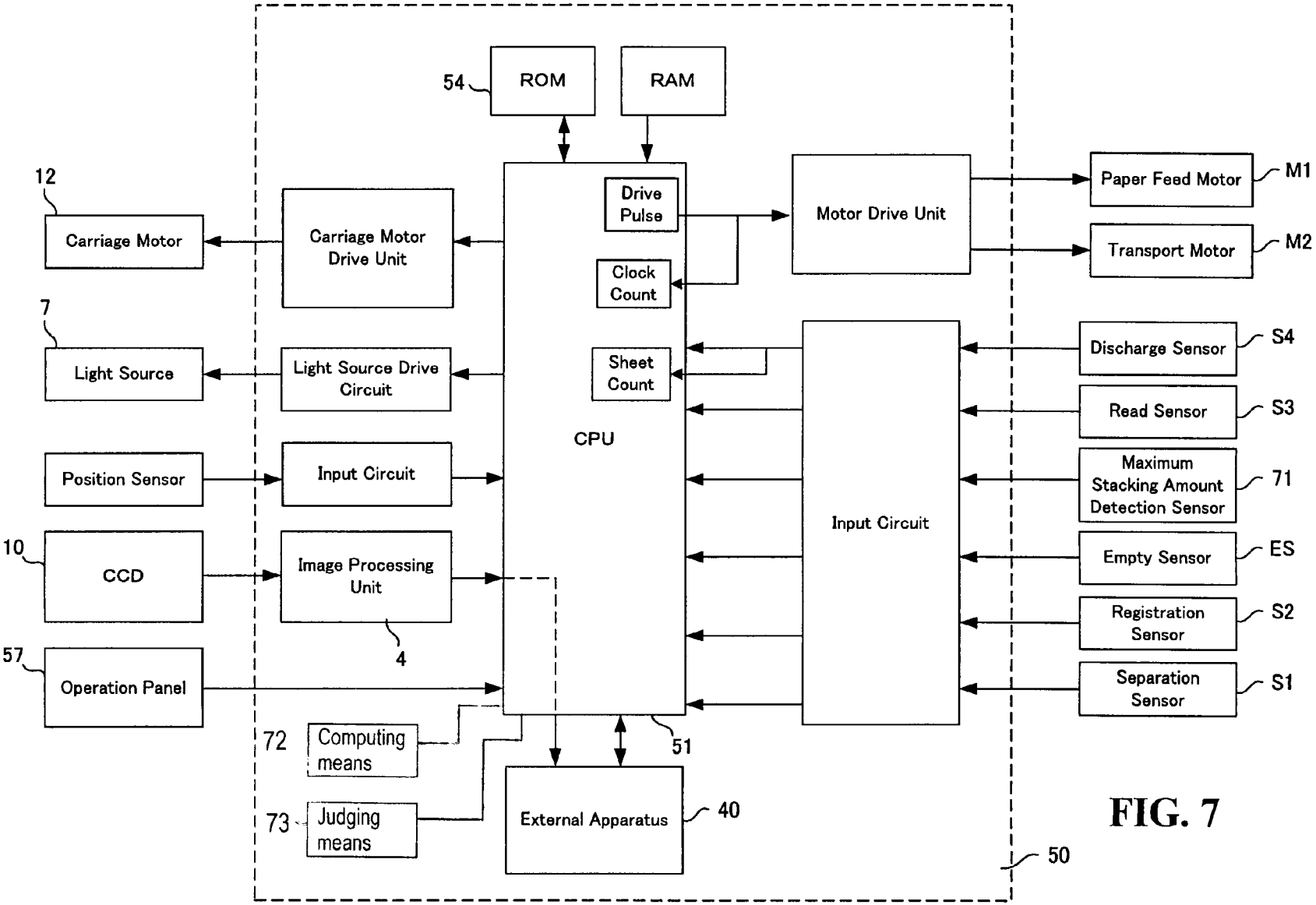
FIG. 7 is a conceptual view of the control system for the image reading apparatus and the sheet transport apparatus.

The following shall describe the control of the image reading apparatus A and the sheet transport apparatus B in reference to the control block of FIG. 7. The image reading apparatus A reads the sheet original that is placed on the platen 2 using a photoelectric reading mechanism unit 3 that is well known. After processing the image at the image processing unit 4, that data is sent to an external apparatus 40 such as a computer or printer. The control of the photoelectric reading mechanism unit 3 is performed by the control unit 50. Note that the image processing unit 4 is composed of an IC for image data processing and an IC for data transmission. This unit processes images by performing line correction, gamma correction and shading correction.

The CPU 51 is composed of a processor for executing the control programs of the ROM 54. Furthermore, the CPU 51 controls the drive of the carriage drive motor 12, the light source 7, and the photoelectric conversion elements 10. It also controls the reading of images of the sheet original.

Furthermore, the CPU 51 controls the drive motors M1 and M2 of the sheet transport apparatus B according to the detection signals from the separating sensor S1, the registration sensor S2, the read sensor S3, the discharge sensor S4 and empty sensor ES.

The following will describe the actions of the image reading apparatus A and the sheet transport apparatus B.

First, an operator uses the keys on an operation panel 57 to select either a manual setting mode that sets the sheet original on the first platen 2*a*, or an automatic feeding mode that sets the sheet original on the second platen 2*b*. Reading conditions such as for reading a color image, grey scale or black-and-white image, or the resolution and density of the image can be set using this operation panel 57. Note that reading conditions and operating modes can also be set for the image reading apparatus A. This is shown in the drawings using an execution screen on an external apparatus 40, such as a personal computer, in addition to the operation panel, in the same way as the normal apparatus.

When the operating mode is set, the CPU 51 executes a program that is supplied from the ROM 54 using the processes outlined below. If the manual setting mode has been selected, the CPU 51 selects one of a plurality of predetermined speeds for the scanning speed of the carriage 6 according to the reading conditions, mentioned above. Next, a position sensor, not shown, detects whether the carriage 6 is at its home position on the right side of FIG. 1, and shifts the carriage drive motor 12 at a set speed from the right side of FIG. 1 to the left side. With the movement of this carriage 6, images on the sheet original that has been placed on the first platen 2*a* are electrically read in sequence by a photoelectric conversion element 10. Those images are processed at the image processing unit 4 and then transferred to an external apparatus 40.

Next, if the automatic feeding mode has been selected, reading conditions such as whether to read a single side of the sheet originals or to read both sides of the sheet original, color, black-and-white and image resolution are set using the operation panel 57 or the external apparatus 40. Then, according to these setting conditions, the CPU 50 moves the carriage 6 from its home position to the left side of FIG. 1, and then stabilizes the carriage 6 at the second platen 2*b* position.

On the other hand, the sheet transport apparatus B starts up the drive motor M1 to send the sheet original on the sheet feeding tray 15 to the pair of registration rollers 24. The drive motor M1 is stopped for a predetermined amount of time after the registration sensor S2 detects the leading edge of the sheet original. Then, the leading edge of the sheet original strikes the pair of registration rollers 24 to form a curl. The system idles at this position.

After the predetermined amount of time has passed, the drive motor M1 rotates in the reverse direction and the pair of registration rollers 24 sends the sheet original in the downstream direction. Based on the detection of the read sensor S3 of the leading edge of the sheet original in the transport path 25, it is recognized that the leading edge of the sheet original has reached the reading position on the second platen 2*b* and the images on the sheet original are read by the photoelectric conversion element 10 as the sheet original passes over the reading position. Signals from the photoelectric conversion element 10 are held in a buffer of the image processing unit 4 where correction processing such as line correction is performed on that data as the effective signals from the reading starting line that has been calculated from the signal of the read sensor S3. Those signals are then transferred to the external apparatus 40.

In the process, the transfer-in roller 27 and the transport-out roller 29 feed the sheet original at the transport speed that corresponds to the reading conditions. If the system has been set for the single-side reading mode to read only one side of the sheet original, the sheet original is transferred out to the holding tray 16 from the second platen 2*b* going through the transport-out roller 29. However, if the system has been set for the duplex mode, the sheet original is turned over from front to back and sent from the transport-out roller 29 to the re-circulating path 32. Then, it is sent to the pair of registration rollers 24 again and re-fed to the reading position on the second platen 2*b*. Then, in order to reorder the pages of the sheet originals that are discharged to the holding tray 16, the sheet original is transported from the recirculating path 32 to the second platen 2*b* again to be turned over from front to back. The sheet originals are then transported to the holding tray 16 by the transport-out roller 29.

Next will follow a description of the sheet holding apparatus C that is incorporated into the sheet transport apparatus B described above. Referring to FIGS. 1 to 4(*a*) and 4(*b*), the sheet holding apparatus C is composed of a holding tray (the holding tray 16 that is described above) for stacking and storing sheet originals; transport means (the transport-in roller 27, the transport-out roller 29, and the pair of discharge rollers 30 and 31); a level detection lever 70 for detecting the surface level of sheets stacked and stacking tray; and detection sensor 71 for detecting the position of the level detection lever 70; computing means 72 for counting the number of sheets that are transported out from the transport means to the discharge tray; and judging means 73 for judging the amount of sheets that are stacked.

Figure 4A:
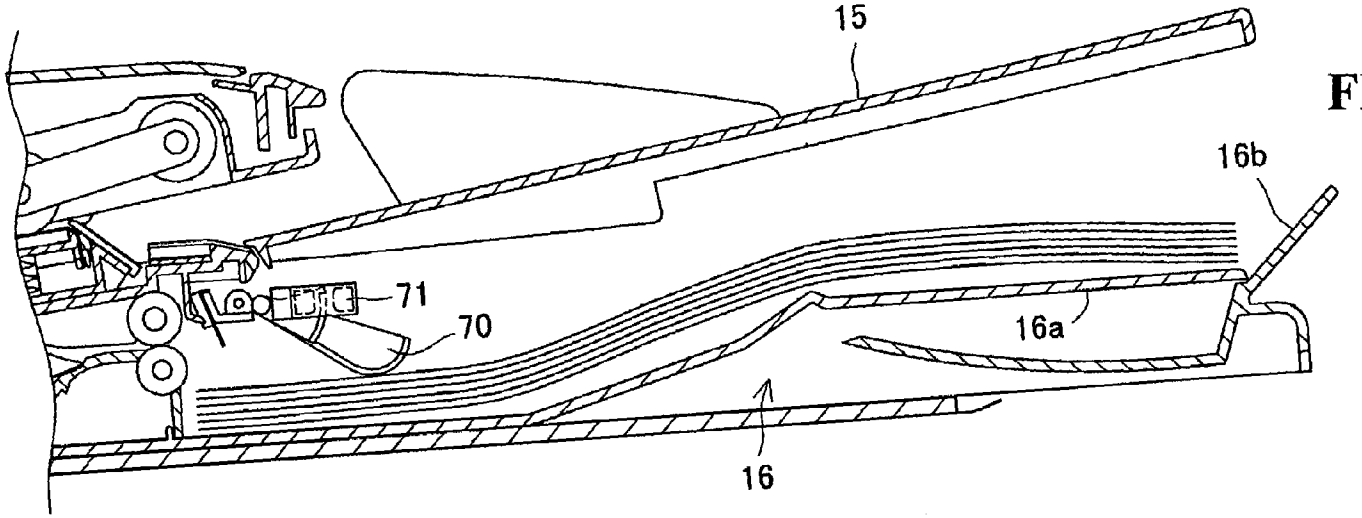
FIGS. 4(*a*) and 4(*b*) show a stack of sheets in the sheet holding apparatus, wherein FIG. 4(*a*) is a sectional view of small-sized sheets stacked, and FIG. 4(*b*) is a sectional view of large-sized sheets stacked.
Figure 4B:
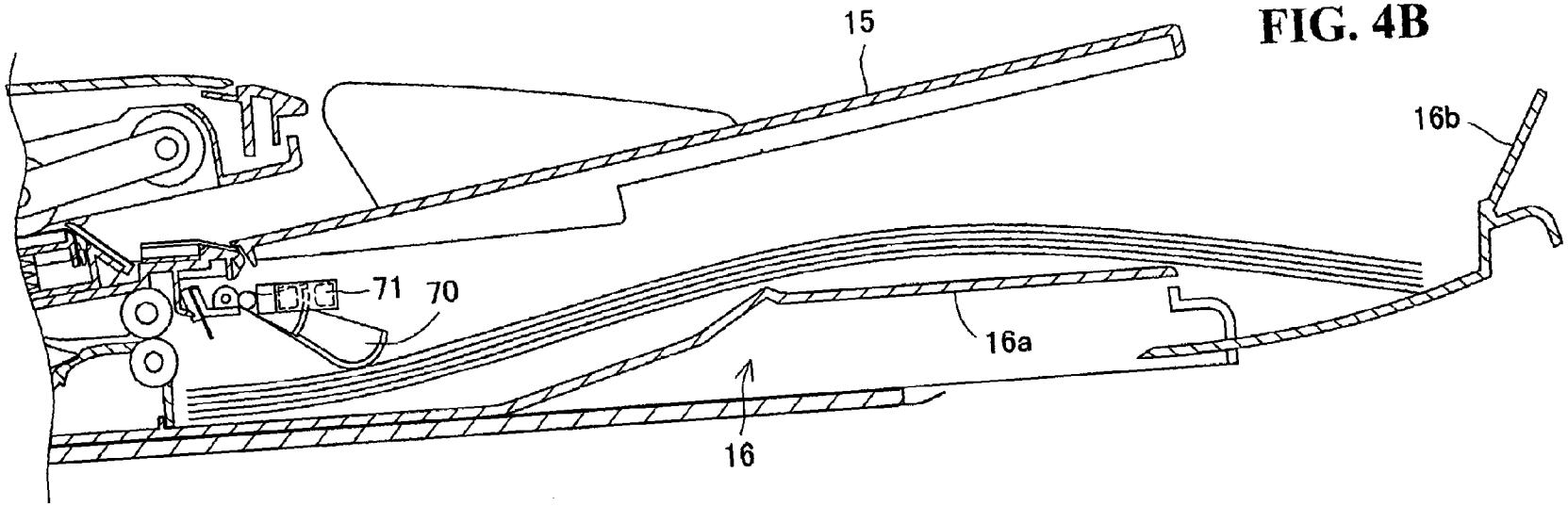

Referring specifically to FIGS. 4(*a*) and 4(*b*), the holding tray 16 is configured as a tray positioned at a level below the pair of discharge rollers 31 and 31 so that it can sequentially stack and hold sheets that are discharged thereto. In the drawing, holding tray 16 includes a stationary tray 16*a* arranged below the sheet feeding tray 15, and an extending tray 16*b* that is mounted to extend the stationary train 16*a*.

The stationary tray 16*a* is arranged obliquely so that the upstream side in the direction of transporting a sheet out is lower and the downstream side is higher. This arrangement aligns the trailing edge of the sheets that are discharged from the pair of discharge rollers 30 and 31. The extending tray 16*b* is matingly supported on a portion of the stationary tray 16*a* and extends by being pulled out to change its size to accommodate different sheet sizes.

The inclination of sheets that are stacked on the holding tray can vary because of the length, thickness or the turning of the sheets. Large-sized sheets or thin sheets can curl when held.

The level detection lever 70 is disposed so that its leading edge hangs downward from above the holding tray 16 to come into contact with the uppermost sheet held therein. Its base is swingably supported on the apparatus frame 74 (FIG. 3).

The detection sensor 71 is composed of a photocoupler that touches the base portion 70*a* (FIG. 3) on the level detection lever 70. This detects whether the base portion 70*a* on the level detection lever 70 is positioned between the light emitting elements and the light receiving element.

As shown in FIG. 3, the level detection lever 70 is arranged on the lower side of the tray surface so that it extends into the sheet path (trail) from above the pair of discharge rollers 30 and 31 that transport the sheets to the discharge tray 16. The base portion 70*a* above is swingably supported by the shaft 75 on the apparatus frame 74. Furthermore, this level detection lever 70 comprises a weight member that swings around the shaft 75 in the counterclockwise direction of FIG. 3 by sheets that are transported out by the pair of discharge rollers 30 and 31.

A flag 76 is coupled to the shaft 75. This flag 76 turns on and off sensor 71, which comprises a photosensor, when it is positioned between the light emitting unit and light receiving unit of the sensor. Therefore, when the level detection lever 70, which touches and follows the level of the uppermost sheet of the sheets stacked on the holding tray 16, reaches the predetermined sheet surface level, the flag 76 switches the detection sensor 71 from an off state to an on state. This predetermined sheet surface level is set to an appropriate level where the sheets that are stacked on the holding tray 16 will not overflow.

FIG. 12 shows three tables of data of the amount of sheets stacked on the holding tray 16 having the configuration described above by the pair of discharge rollers 30 and 31, and that was detected by the level detection lever 70 and the detection sensor 71 of the configuration described above. This data is the result of judging when the detection sensor 71 was switched from an off state to an on state under the differing conditions of sheet sizes and speed of the pair of discharge rollers 30 and 31. In FIG. 12, LT and A4 represent letter sizes, LG and B4 represent legal sizes and B5 represents a smaller standard size. Vertical represents transporting sheets in the lengthwise direction and sending it to be held in the tray, whereas Horizontal (not shown) refers to transporting the sheet in the width direction. Also, single side refers to reading only one side of a sheet original, and duplex refers to reading both sides of a sheet original. The gap between sheets being consecutively transported differs between the two modes.

Note that this data was obtained through testing to be at a range wherein the sheets stacked on the holding tray 16 cannot cause sheets to be scattered outside of the tray because of overflow, or that subsequent sheets did not clog or become jammed inside the apparatus (in the transport path).

It can be understood from that data that as the speed of the pair of discharge rollers 30 and 31 increases, the number of sheets that are stacked is reduced; and as the speed is reduced, the number of sheets that are stacked increases. Furthermore, this table shows that as the length of the transport direction increases, the number of sheets that are stacked is reduced. In other words, even when the structure of the level detection lever 70 is the same, the number of sheets detected by this level detection lever 70 may be different based on the speed of transporting sheets to the tray, the intervals between sheets, and the length in the transport direction of sheets.

For example, according to that data, if transporting A4 sized sheets in the vertical direction at a speed of 388 mm/s, the number of sheets that can be transported out is 34.3 (the average value of a plurality of experiments); if transporting B5 size sheets in the vertical direction and at a speed of 97 mm/s, the number of sheets is 70.2. Therefore, there is a difference of approximately 36 sheets between transporting A4 size sheets in the vertical direction at a speed of 388 mm/s, and transporting B5 size sheets in a vertical direction and speed of 97 mm/s.

Thus, according to the present invention, the following procedures are applied to judge the maximum stacking amount of the holding tray 16 using the configuration described above. After the level detection lever 70 has reached the predetermined surface level of stacked sheets, a further tolerable amount of a number of sheets is set based on testing values shown as an example in FIG. 12.

Next, the detection sensor 71 detects whether the level detection lever 70 is positioned at the predetermined sheet level, and it counts the number of sheets transported out to the holding tray 16 after the uppermost sheet on the holding tray 16 has reached a predetermined sheet level. It judges whether this number of counted sheets matches the number sheets that were set according to the values attained in the experiments. If both match, the judging means recognizes that the maximum stackable amount has been reached.

Figure 8:
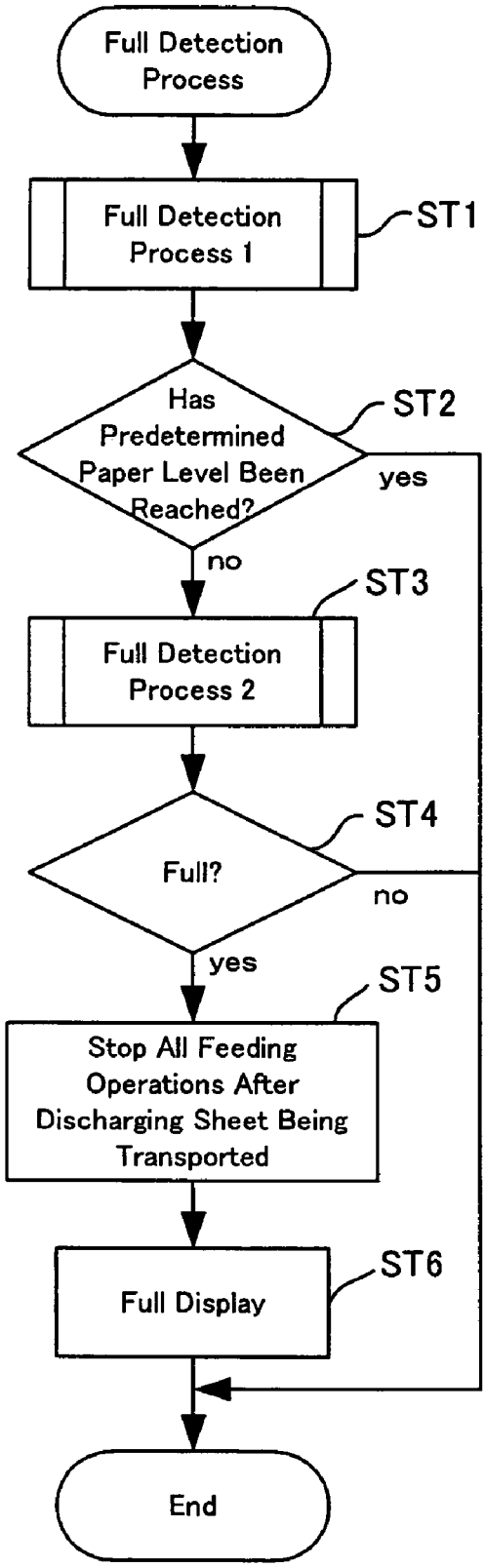
FIG. 8 is a main flowchart for detecting the maximum stacking amount of sheets.
Figure 9:
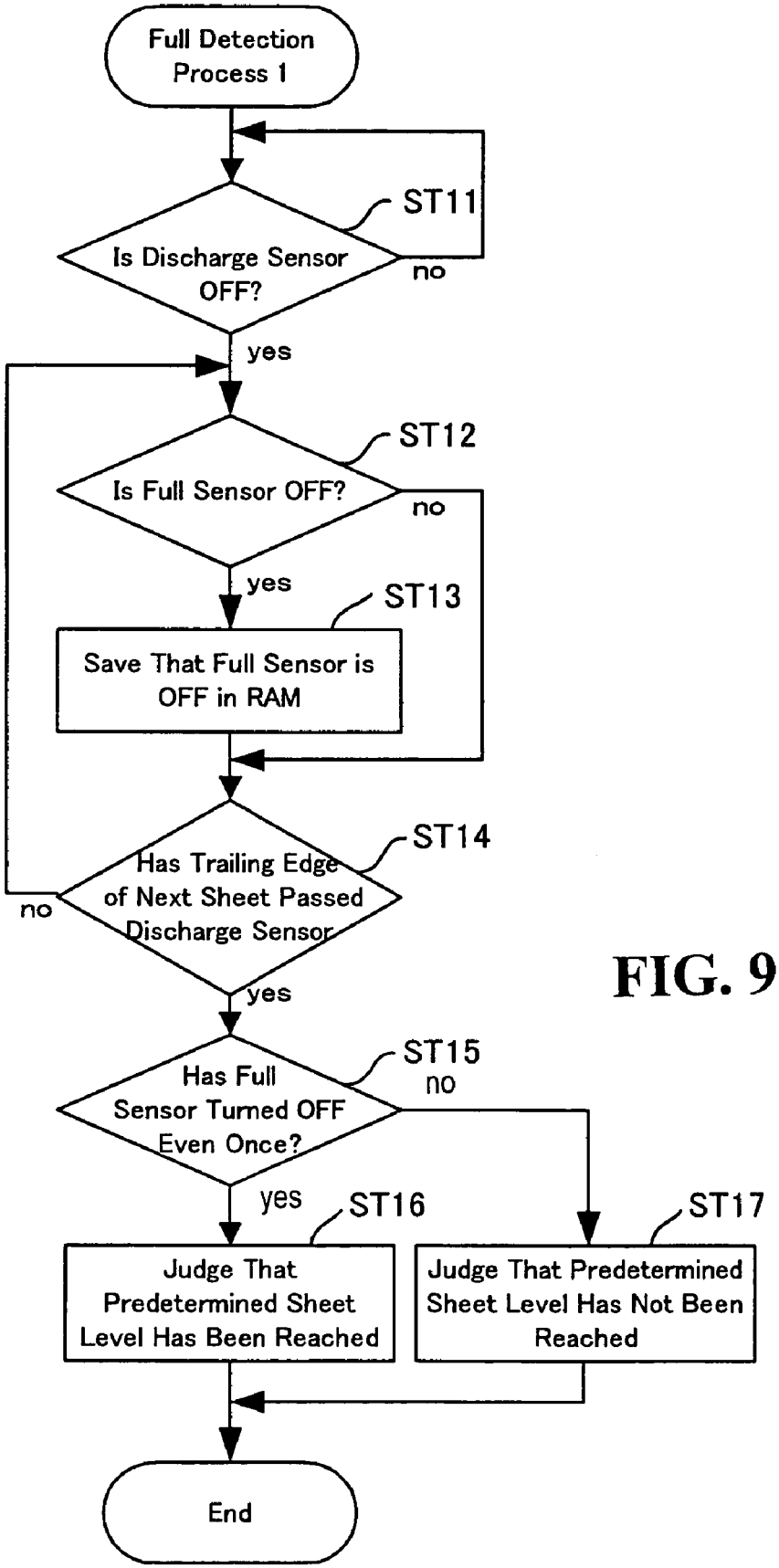
FIG. 9 is a flowchart for detection process 1 for detecting the maximum stacking amount of sheets.
Figure 10:
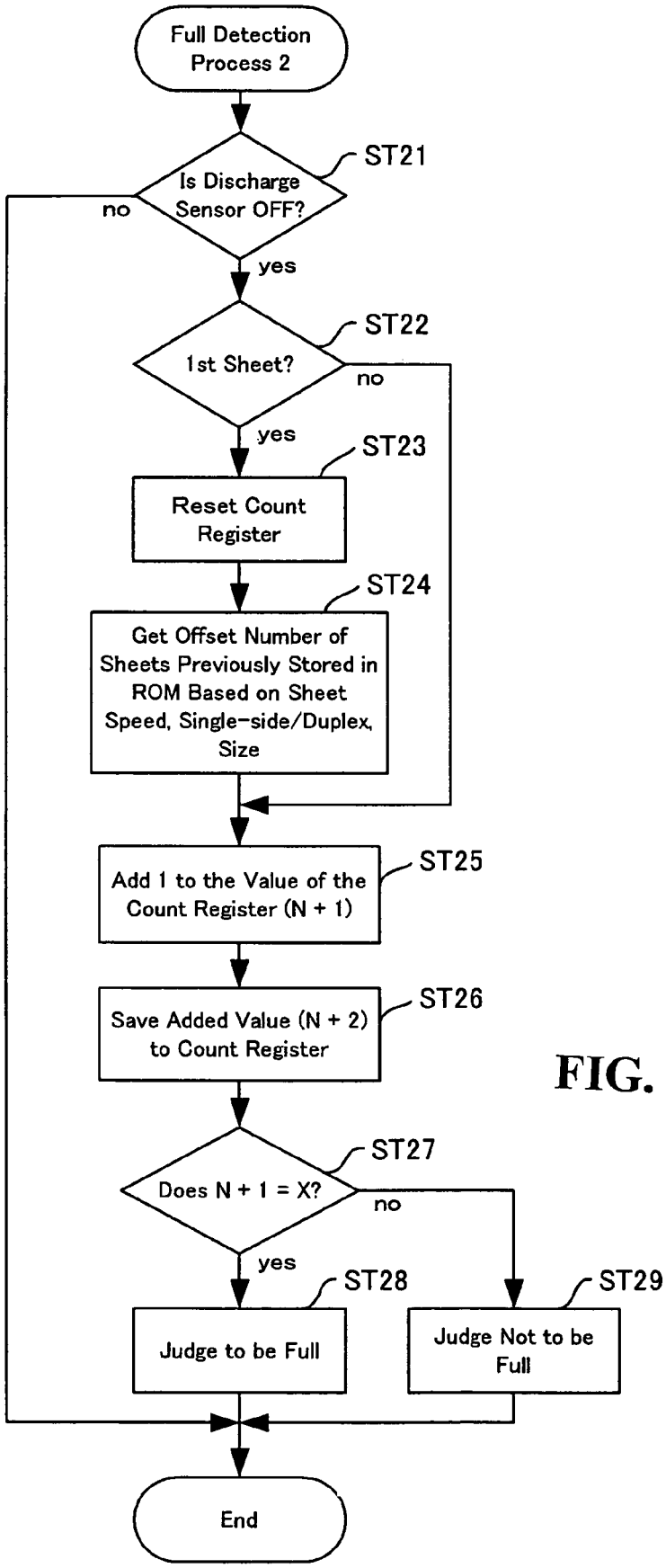
FIG. 10 is a flowchart for detection process 2 for detecting the maximum stacking amount of sheets.

The flow charts shown in FIG. 8 to FIG. 10 shall be used to describe the detection process for determining the maximum stackable amount.

First, in the process to detect the maximum stackable amount, detection process 1 for the maximum stackable amount is executed to detect the sheet surface level using the detection sensor 71, as shown in FIG. 8. In the drawings, this is referred to as process for detecting that the tray is full, or Full Detection Process 1 (ST1). If the detection sensor 71 has detected that the predetermined sheet level has been reached, detection process 2 for the maximum stackable amount is executed to detect the number of sheets discharged by counting the number of sheet originals that are discharged (ST3). Then, if the number of sheets that has been discharged reaches a predetermined value, it is detected that the number of sheet originals discharged to the holding tray 16 has reached the maximum stackable amount (ST4). Only the transport operation for the sheet is being transported at that point is continued, and the feeding operation of subsequent sheet originals from the sheet feeding tray is stopped (ST5). The operator is notified that the maximum amount has been reached using the display panel or the lighting of an LED (ST6). This prompts the operator to remove those discharged sheet originals.

Specifically, according to the described embodiments, the detection of the maximum stacking amount is performed by detecting whether the amount of sheet originals stacked on the holding tray 16 has reached a predetermined amount (the maximum stacking amount) using the status of the detection sensor that detects the sheet surface level, and the total count for the number of sheets that have been discharged.

To describe this process in detail, referring to FIG. 9, detection process 1 detects the surface level of the sheets using the detection sensor 71. When the trailing edge of the sheet has been detected to pass the discharge sensor S4 (turned off) (ST11), detection using the detection sensor 71 is started. With the start of that detection, the CPU judges whether the detection sensor 71 is in an off state or and on state (ST12). If the sensor is in an off state, the results are saved in RAM (ST13). This judgment of the on and off state of the detection sensor is repeatedly executed until subsequent sheets have passed the discharge sensor S4 (ST14), and detection using the detection sensor 71 is ended (ST15). Then, if the detection sensor 71 did not turn off even once (when it is still on) the system judges that the predetermined sheet level has not yet been reached (ST17). Conversely, if the detection sensor 71 turns OFF even once, it is judged that the predetermined size sheet level has been reached (ST16).

When judging whether the predetermined position has been reached for the sheet surface using the detection sensor 71 in detection process 1, it is not possible to obtain the correct results due to the differences in discharging speed of sheet originals, the intervals between sheet originals, and the size of sheet originals (the length of sheet originals).

Therefore, after it has been judged that the discharged originals have reached the predetermined sheet surface level in detection process 1, the detection process 2 is executed. Detection process 2 shall be described in reference to FIG. 10.

In detection process 2, the system is configured to count the signals for each time the trailing edge of the sheet passes the discharge sensor S4.

More specifically, when the discharge sensor S4 turns off, the system judges whether the counted sheet original is the first sheet or not (ST21 to ST22). Then, if it is the first sheet, the RAM register which holds the counting data of the number of sheets that have been discharged (the count register) is reset to 0 (ST23). The system selects one of a plurality of sheet count data based on the discharge speed, single sided/duplex, and sheet original size, where the plurality of sheet count data is previously stored in a predetermined area in the ROM 54 (ST24). On the other hand, the steps ST23 to ST24 are not executed for the second sheet and subsequent sheets.

The CPU 51 reads the count register data, adds one and holds that in the count register again (ST25 and ST26). Then, the CPU compares the number of sheets received from the ROM 54 and the number of sheets in the count register (ST27). If both match, then it is judged that the maximum stacking amount has been reached (ST28). If the counted sheets are not at least equal to the predetermined number of sheets received from the ROM 54, then the maximum stacking amount has not been reached, and the tray is not full (ST29). In other words, a program is executed in the CPU 51 as comparison means for comparing whether a match exists between the number of sheets held in the ROM 54 and the number of sheets that have been counted match. For example, judging means 73 is executed to determine if both match in the comparison means, and thereby to determine if the maximum sheet capacity is achieved.

The following shall describe the executions at ST24 to get sheet count data (hereinafter referred to offset sheet count data) that is held in ROM 54.

There are cases that the detection sensor 71 detects the position of the level detection lever 70 just prior to a sheet that is being discharged to the holding tray 16 has completely fallen onto a sheet that is already held (and is pressed against that sheet), thereby erroneously detecting an on state. The actual number of held sheets is different when the level detection lever 70 has reached a predetermined sheet surface level because of the speed of the sheets being transported out, the sizes of the sheets, and the intervals between the sheets (discharge gaps are different when reading in the duplex mode as shown in the experiment data in FIG. 12). A plurality of sheet offset sheet count data that is preset based on the experimental data shown in FIG. 12 is held in ROM 54.

One of the plurality of offset sheet count data that is held in ROM 54 is selected when the program is executed by the CPU 51. The CPU 51 determines which offset sheet count data to select according to the settings of the reading conditions (such as the single side reading mode and the duplex reading mode selection signal).

Reading conditions can be set by inputting information from an operation panel on the image reading apparatus A, or from an external apparatus 40 such as a personal computer that is linked to the image reading apparatus A.

Representative reading condition settings can be offered as a single side reading mode that reads one side of sheet originals, a duplex mode, or image reading resolution conditions such as color, black and white or gray scale. When these reading conditions have been set, the photoelectric conversion element 10 sets to read in a single-line black-and-white mode or to read in the three-line RGB mode. At the same time, one of three sheet transport speeds (high, medium, and low) is set for the resolution conditions. The transport conditions on the sheet transport apparatus B are also set for whether the single-side reading mode or the duplex mode will be used to read images on the sheets.

Then, according to these reading condition settings, one of the offset sheet counts in ROM 54 is selected. For example, one of the different values of the sheet offset data, or "correction sheets" as shown in FIG. 12, is selected according to the size of the sheet in the transport direction.

Figure 11:
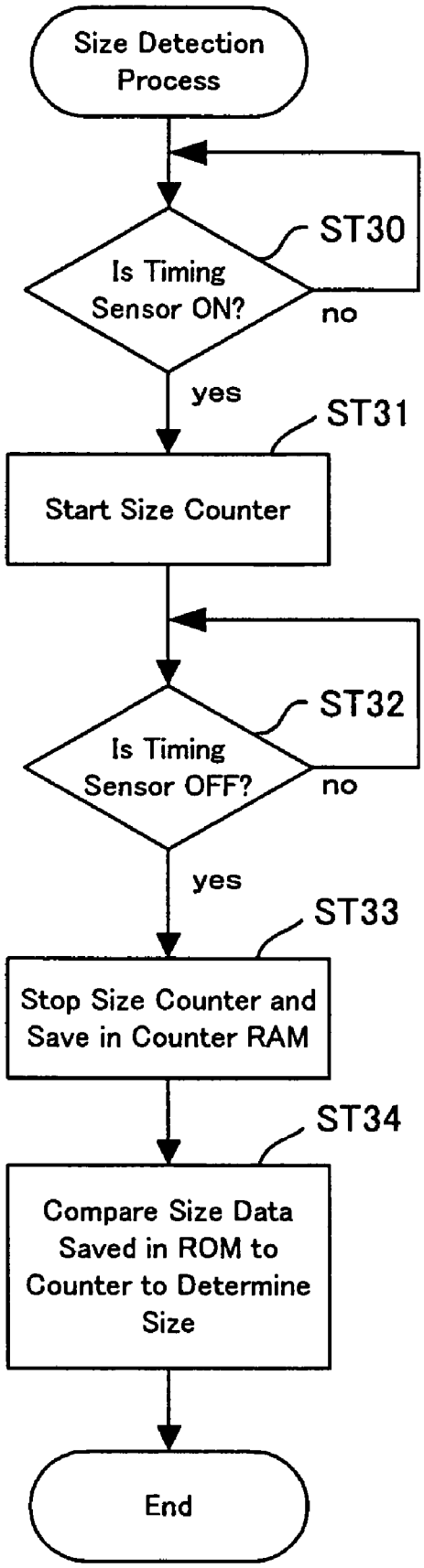
FIG. 11 is a flowchart for detecting the length of sheets in the transport direction.

Referring to FIG. 11, in determining the size of the sheet original for acquiring the offset count, a size counter counts from when the leading edge of the first sheet to be read is detected by the read sensor S3, until its trailing edge is detected (ST30 through ST33). Then, the size is determined by comparing the results of this count with a plurality of size data prerecorded in the ROM 54 (ST34).

Note that the size counter according to this described embodiment counts the drive pulse signals from the transport motor M2.

Also note that in this embodiment, the offset number of sheets is selected from a plurality of offset number of sheets data that is stored in ROM 54 according to the mode (single-side, or duplex), the sheet original size, and the transport speed. However, the invention is not limited to this. It is perfectly acceptable to establish a means for detecting the thickness of sheets and then selecting one of the offset number of sheets values that is stored in ROM 54 according to the results of the detection of the thickness detection means. In such a case, it is possible to adjust the number of sheets that are stacked according to the thickness of the sheets, so it is possible to prevent mistakes in transport caused by sheet thicknesses.

Furthermore, this embodiment describes a holding apparatus that is employed in a sheet transport apparatus equipped on an image reading apparatus. Nevertheless, this can also be a holding apparatus that holds sheets which had been printed using an image forming apparatus as well.

According to the embodiment described above, the system judges the maximum stacking amount of sheets held in a holding tray using a level detection lever the detects the sheet surface level and information from a computing means that counts the number of sheets that have been transported out. Therefore, it is always possible to accurately detect the maximum stacking amount by using computing means to offset detection errors of the detection lever that are caused by excessive sheet swelling because of curls or the existence of sheets already in the holding tray or the differences in sheet transport speed and intervals between sheets. At the same time, problems of an excessive number of sheets being stacked upon the holding tray causing sheets that are being transported out to become jammed or pushing those sheets on the tray outside of the tray are alleviated. Still further, the problem of the machine being stopped by erroneously judging that the maximum amount of sheets that can be held has been reached when there are too few sheets stacked is also solved.

Still further, it is possible to make a plurality of settings according to the variety of sheet transport conditions by detecting a predetermined amount of sheets stacked on a tray using a detection lever, and judging whether the maximum amount of a holding tray has been reached by whether the counter value of the computing means for counting the sheets that are subsequently stacked on the tray matches a predetermined set number of sheets. This eliminates any variation in the maximum allowable number of sheets that can be stacked by the differences in operating modes of the apparatus.

The disclosure of Japanese Patent Application No. 2004-49393 filed on Feb. 25, 2004 is incorporated herein.

While the invention has been explained with reference to the specific embodiments of the invention, the explanation is illustrative and the invention is limited only by the appended claims.

What is claimed is:

1. A sheet holding apparatus for holding sheets that have undergone a process at a predetermined position comprising:

a holding tray for stacking and holding sheets;

transport means for transporting sheets to said holding tray;

a detection lever movable to contact an uppermost sheet stacked on said holding tray;

detection means for detecting whether said sheets stacked on said holding tray have reached a predetermined amount according to a movement position of said detection lever;

data recording means for recording a plurality of sheet count data;

selecting means for selecting one count data from the plurality of said sheet count data stored in said data recording means;

computing means for counting a number of sheets transported from said transport means to said holding tray after detection by said detection means; and judging means for judging a maximum amount of sheets on said holding tray by comparing the number of sheets counted by said computing means to a number of sheets selected by said selecting means.

2. The sheet holding apparatus according to claim 1, wherein said computing means is composed of a sheet detection sensor, arranged in a sheet transport path leading to said holding tray, that detects passing of sheets, and a counter that counts signals from said sheet detection sensor.

3. The sheet holding apparatus according to claim 1, wherein said-detection means has a detection sensor for detecting that said detection lever has moved to a predetermined position, and a sheet detection sensor for detecting whether sheets transported to said holding tray have reached a maximum amount by detecting the movement of said detection lever to a predetermined position from a first trailing edge of a first sheet transported to said holding tray to a second trailing edge of a next sheet transported to said holding tray.

4. The sheet holding apparatus according to claim 1, wherein said transport means includes a plurality of transport modes in which at least one of a transport speed of sheets or transport intervals of sheets transported by said transport means is different; said selecting means selects one count data from the plurality of sheet count data stored in said data recording means, according to said transport modes.

5. The sheet holding apparatus according to claim 1, further comprising sheet size detection means for detecting a size of sheets transported by said transport means; wherein the selecting means selects one count data from the plurality of sheet count data stored in said data recording means, according to a size of a sheet detected by said sheet size detection means.

6. The sheet holding apparatus according to claim 5, wherein the selecting means selects one count data from the plurality of sheet count data stored in said data recording means, according to a thickness of a sheet detected by said sheet size detection means.

7. A sheet transport apparatus equipped with a sheet holding apparatus for holding sheets that have been read at a reading position for reading images thereupon, comprising:

sheet feeding means for sequentially feeding a plurality of sheets stacked on a sheet feeding tray to said reading position;

transport means for sequentially transporting sheets from said sheet feeding means to a holding tray passing through said reading position;

a detection lever movable to contact an uppermost sheet on said holding tray;

detection means for detecting whether said sheets stacked on said holding tray have reached a predetermined amount according to a movement position of said detection lever;

computing means for counting number of sheets discharged from said transport means to said holding tray after detection by said detection means of a predetermined amount of stacked sheets;

data recording means for recording a plurality of sheet count data;

selecting means for selecting one count data from the plurality of sheet count data stored in said data recording means; and judging means for judging a maximum amount of sheets on said holding tray by comparing the number of sheets counted by said computing means to a number of sheets selected by said selection means.

8. The sheet feeding apparatus according to claim 7, further comprising sheet size detection means for detecting a size of sheets transported by said transport means; wherein the selecting means selects one count data from the plurality of sheet count data stored in said data recording means, according to a size of a sheet detected by said sheet size detection means.

9. The sheet feeding apparatus according to claim 7, further comprising control means for controlling a speed for transporting sheets by said transport means to said holding tray according to reading conditions for reading said sheets; wherein the selecting means selects one count data from the plurality of sheet count data stored in said data recording means, according to a transport speed controlled by said control means.

10. The sheet feeding apparatus according to claim 7, further comprising control means for controlling intervals between sheets sequentially transported by said transport means to said holding tray according to reading conditions for reading said sheets; wherein the selecting means selects one count data from the plurality of sheet count data stored in said data recording means, according to intervals between sheets that are controlled by said control means.

11. A sheet holding apparatus for holding sheets that have undergone a process at a predetermined position comprising:

a holding tray for stacking and holding sheets;

transport means for transporting sheets to said holding tray;

a detection lever movable to contact an uppermost sheet stacked on said holding tray;

detection means for detecting whether said sheets stacked on said holding tray have reached a predetermined amount according to a movement position of said detection lever;

wherein said transport means is controlled to change a number of sheets transported to said holding tray after said detection means detects the predetermined amount of the sheets on the holding tray, according to sheet transport conditions of sheets transported by said transport means; and wherein said transport conditions include intervals between sheets sequentially transported to said holding tray by said transport means.

* * * * *